US008978331B2

(12) United States Patent
Bowerman

(10) Patent No.: US 8,978,331 B2
(45) Date of Patent: Mar. 17, 2015

(54) BUILDING CONSTRUCTION WITH LOST SHUTTERING AND CONSTRUCTION METHOD

(75) Inventor: Hugh Gordon Bowerman, Surrey (GB)

(73) Assignee: Verteka Ltd., Surrey (GB)

( * ) Notice: Subject to any disclaimer, the term of this patent is extended or adjusted under 35 U.S.C. 154(b) by 477 days.

(21) Appl. No.: 12/224,305

(22) PCT Filed: Mar. 1, 2007

(86) PCT No.: PCT/GB2007/000711
§ 371 (c)(1),
(2), (4) Date: Oct. 8, 2008

(87) PCT Pub. No.: WO2007/099321
PCT Pub. Date: Sep. 7, 2007

(65) Prior Publication Data

US 2009/0064619 A1 Mar. 12, 2009

(30) Foreign Application Priority Data

Mar. 3, 2006 (GB) ..... 0604364.0

(51) Int. Cl.
*E04C 2/00* (2006.01)
*E04B 2/86* (2006.01)

(52) U.S. Cl.
CPC ..... *E04B 2/8635* (2013.01); *E04B 2002/867* (2013.01)
USPC ..... 52/426; 52/236.9; 52/649.1

(58) Field of Classification Search
CPC .... E04B 2/8635; E04B 2/8641; E04B 2/8617
USPC ..... 52/424–428, 430, 236.8, 649.1
See application file for complete search history.

(56) References Cited

U.S. PATENT DOCUMENTS 1,037,099 A * 8/1912 York ..... 29/897.33
1,890,532 A * 12/1932 Skolnik ..... 52/563

(Continued)

FOREIGN PATENT DOCUMENTS

GB 2278083 A * 11/1994 ..... B32B 7/02
GB 2436841 A 10/2007

(Continued)

OTHER PUBLICATIONS

Examination report in corresponding application No. EP07705296.7 dated Nov. 22, 2013.

*Primary Examiner* — Elizabeth A Plummer
(74) *Attorney, Agent, or Firm* — Edward J. Stemberger; Manelli Selter PLLC

(57) ABSTRACT

A plurality of pre-formed panels are provided. Each panel comprises construction boards held apart from each other by spaced apertured metal strength members (2) to form a sandwich construction. Each strength member is provided with at least one bar (10) extending beyond an edge of the construction boards. Each strength member has a bar receiving portion (63) associated with its end opposite the at least one bar. To construct a wall, a first such panel is first erected with its strength members (2) extending vertically and with the bars (10) projecting above the remainder of the panel. The void between the construction boards is then filled with a settable material. A second panel is located vertically above the first by slotting the bars of the first panel into bar receiving portions of strength members in the second panel. Thereafter, the void between the construction boards of the second panel is filled with the settable material.

22 Claims, 9 Drawing Sheets

(56) References Cited

U.S. PATENT DOCUMENTS

| | | | | |
|---|---|---|---|---|
| 4,003,207 | A * | 1/1977 | Muller | 405/284 |
| 4,730,422 | A * | 3/1988 | Young | 52/105 |
| 5,065,561 | A * | 11/1991 | Mason | 52/309.12 |
| 5,412,913 | A * | 5/1995 | Daniels et al. | 52/79.13 |
| 5,570,552 | A * | 11/1996 | Nehring | 52/426 |
| 5,704,180 | A * | 1/1998 | Boeck | 52/426 |
| 6,230,462 | B1 * | 5/2001 | Beliveau | 52/426 |
| 6,240,692 | B1 * | 6/2001 | Yost et al. | 52/426 |
| 6,647,686 | B2 * | 11/2003 | Dunn et al. | 52/426 |
| 6,668,503 | B2 * | 12/2003 | Beliveau | 52/426 |
| 6,935,081 | B2 * | 8/2005 | Dunn et al. | 52/426 |
| 7,861,479 | B2 * | 1/2011 | Crosby et al. | 52/426 |
| 8,646,236 | B2 * | 2/2014 | Hilliard, Sr. | 52/426 |
| 2002/0124508 | A1 | 9/2002 | Dunn et al. | |
| 2009/0107065 | A1 * | 4/2009 | LeBlang | 52/252 |

FOREIGN PATENT DOCUMENTS

| | | | |
|---|---|---|---|
| NL | 7111909 | A | 3/1972 |
| WO | WO 85/03966 | A1 | 9/1985 |
| WO | WO 03/046312 | A1 | 6/2003 |
| WO | WO 2005/035900 | A1 | 4/2005 |
| WO | WO 2005/113917 | A1 | 12/2005 |

* cited by examiner

Figure 9
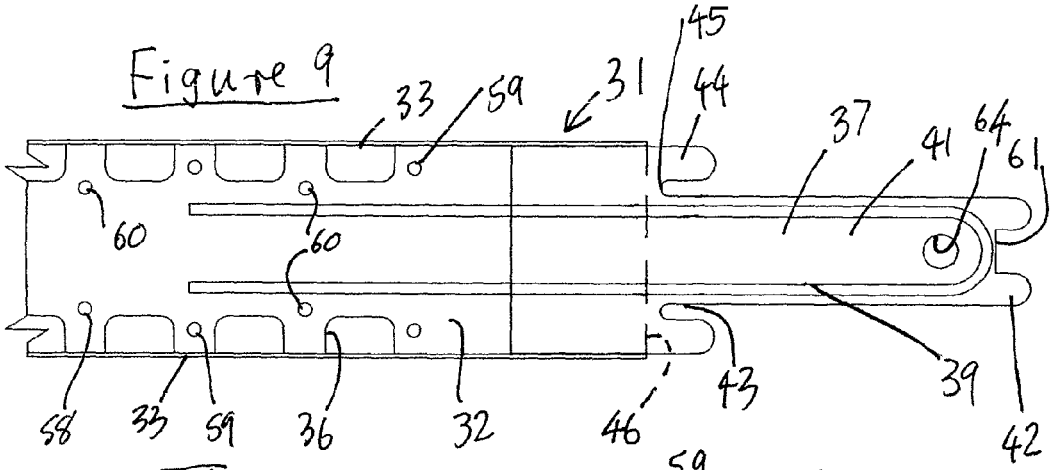
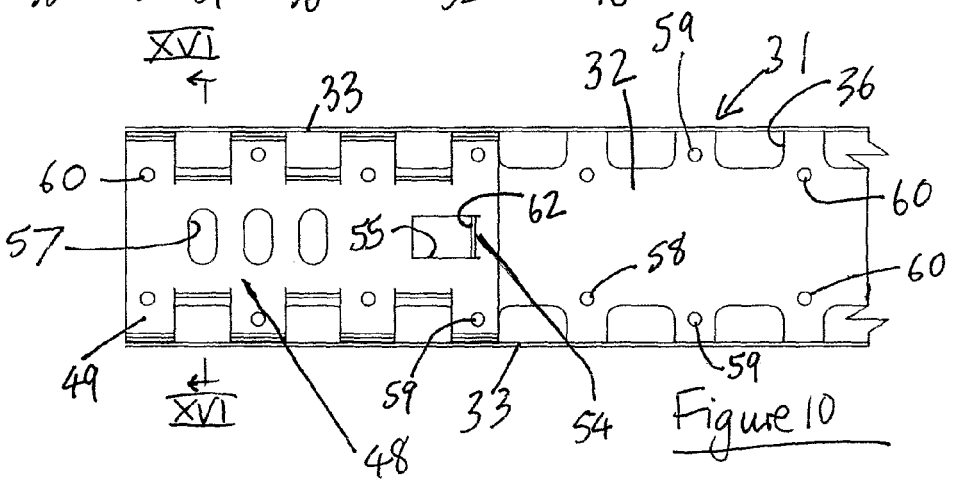
Figure 10
Figure 11
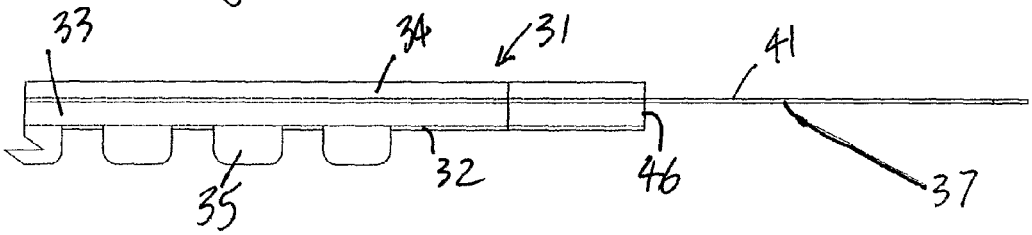
Figure 12
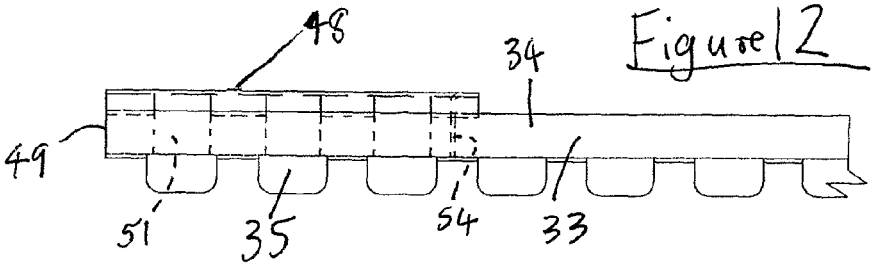

BUILDING CONSTRUCTION WITH LOST SHUTTERING AND CONSTRUCTION METHOD

BACKGROUND

This disclosure relates to building construction, and more specifically to methods for constructing structural reinforced walls of settable material in buildings.

The traditional method of constructing such walls is to cast them in situ. Reinforcing bars are placed within a temporary formwork system, and concrete placed to fill the voids between the reinforcing bars and formwork. Once the concrete has hardened, the formwork is removed. The formwork may be used many times. The time taken to construct each storey of a building using traditional methods is about one storey per week.

The time taken to construct a wall in the traditional manner is a factor limiting the speed of completion of a building structure.

Various methods have been proposed to speed up the process, two examples being 'jump form' and 'slip form'. A requirement of both systems is that the plan layout of the walls must be essentially similar for all storeys within the building. In both cases special formwork is used to form the plan layout. With jump form a single storey is cast before the formwork is jacked or 'jumped' up in preparation for casting the next storey. With slip form the formwork moves up on a more or less continuous basis. Both systems achieve a significant improvement relative to traditional methods with two storeys a week being possible. The drawback is that it can take about 3 weeks to construct the initial formwork. It is also not possible to start follow-on construction until the walls have progressed 3 to 4 storeys ahead. In terms of time, jump or slip forming are therefore not of significant benefit unless the building is more than about 10 storeys high.

An alternative to the in situ casting of concrete is to cast panels off-site, so called pre-cast concrete panels. Reinforcing steel is placed within the panel according to the structural requirements. Panels are transported to site where they are assembled together to form the vertical wall elements of the structure. Where vertical continuity of reinforcement is required, reinforcing bars are left projecting from the top and bottom of the panels such that they overlap when assembled. The gap between panels must then be closed by formwork and the resulting void filled with a concrete grout in order to connect the panels together. Alternatively steel sections may be cast within the panels and these are bolted together. In practice, assembly of a structural wall using pre-cast panels is a relatively slow process, particularly since concrete is heavy and panels sizes are often limited by the available crane lifting capacity which results in lots of joints.

Another method of constructing structural reinforced concrete walls is to use permanent formwork. Various systems have been proposed, of which five are described below:

- Corrugated light gauge steel is constructed into sandwich panels by through bolting at regular intervals. These panels are taken to site where they are bolted together. Where structural vertical continuity is required, vertical reinforcing bars are placed between the sheets to overlap the horizontal joints. Concrete is then placed between the steel sheets. The result is a composite wall. The disadvantage of this system is that the wall is not flat, and hence must be boarded on both sides to give the required architectural finish. Fire protection will also be required.
- Steel/concrete composite sandwich panels systems employ two flat steel plates held apart by an array of transverse steel bars that are welded at each end to the face plates. The resulting panels are assembled together and joined by bolting or welding. The void between the plates is then filled with concrete to result in an immensely strong steel-concrete composite. The disadvantages of this system are the relatively high volume of steel in the face plates (cost) and the need for the addition of finishes and fire protection. Construction can, however, be extremely rapid with large panels (few joints) being possible owing to the relatively low weight of the unfilled panel (typically 150 kg/m$^2$).
- Panels may be made from reinforcing cages with a relatively thin layer of concrete on each face leaving a void down the middle, and are employed in a similar fashion to the steel plates. The panels are assembled a storey at a time and must be propped to hold them in position until assembly and concrete filling is complete. There are a number of similarities with conventional pre-cast concrete. Joints require grouting in order to achieve structural continuity. Construction is not as rapid as some of the other permanent formwork systems, but is quicker than conventional in situ concrete. As with pre-cast panels, the weight of the panels (typically 300 kg/m$^2$) limits panel size and increases the work that must be done in-situ.
- Sandwich panels employing a board-stud-board construction may be employed. Boards are typically timber based or made from an insulating foam composite. Studs may be timber or light gauge steel. Panels are brought to site and bolted/nailed together. The void between the panels is then filled with concrete. Reinforcing steel may be placed between the panels prior to the concrete being placed. Such panels are typically used in low rise construction (up to 3 storeys) and are only nominally structural, especially in a fire condition. Vertical continuity can be achieved by overlapping reinforcing steel, but site construction will be relatively labour intensive. This type of wall is primarily a substitute for traditional masonry rather than an alternative to compete with conventional structural reinforced concrete.
- Hollow STYROFOAM® or similar closed cell polystyrene blocks may be employed to build a wall in a manner not unlike using giant hollow LEGO® bricks. Walls are constructed from the blocks and reinforcing steel placed inside the hollow. Filling the voids with concrete creates a nominally reinforced concrete wall. Due to the thickness of the STYROFOAM®, the thickness of the wall will be higher than other systems for a given strength. The STYROFOAM® finish will generally require further finishes prior to decoration. Again the system is primarily an alternative to conventional masonry rather than a system to replace structural reinforced concrete.

The foregoing systems all provide some benefits when constructing vertical structural walls. However, nearly all of them have some disadvantages. The methods described in detail below seek to address these disadvantages and to enable practical rapid erect vertical structural walling systems.

SUMMARY

In a first aspect of this disclosure: reinforced, filled and set structural walls are constructed by a method comprising the steps of: providing a plurality of pre-formed panels each comprising construction boards held apart from each other by spaced apertured metal strength members to form a sandwich construction, each strength member being provided with at least one bar extending beyond an edge of the construction boards, and each strength member having a bar receiving portion associated with its end opposite the at least one bar; erecting a first said panel with its strength members extending vertically and with the bars projecting above the remainder of the panel; filling the void between the construction boards with a settable material; before, during or after said filling step, locating a second said panel vertically above the first by slotting the said bars into bar receiving portions of strength members in the second panel; and thereafter filling the void between the construction boards of the second panel with said settable material.

Preferred embodiments employ one or more of the following features: The strength members comprise steel studs and the projecting bars are also formed of steel, each bar being welded to an upper portion of a stud, each stud comprising a vertically extending web and flanges joined to the web along its vertically extending edges, the flanges being coupled to the construction boards. The construction boards are attached to the strength members by adhesive or by mechanical fasteners, preferably self-drilling screws. In a preferred arrangement the construction boards are attached to the strength members by an adhesive including an intumescing additive. Each projecting bar is provided with a corrosion protection layer of zinc galvanising or paint. The projecting bars and/or the studs, especially the lower ends of the studs, are provided with a surface profile to key into the settable material such that when such material fills the voids in the second panel and sets, tension continuity is established between the studs of the two panels. The surface profile comprises a profile rolled into the surface of the bar or studs during manufacture. The surface profile comprises a serrated or re-entrant shaped edge profile for the stabbing bar. The surface profile is provided by adhesively bonded aggregate particles attached to the surface of the bar or to the stud. In a preferred arrangement, the strength member is provided with a single stabbing bar projecting substantially along the centreline of the stud, and formed from a profiled plate having a first surface on one side and a second surface on its other side, a looped portion of reinforcing rod being welded to at least one of said first and second surfaces to provide enhanced keying between the stabbing bar and the settable material. The strength members of each panel are interconnected by lateral reinforcement. A plurality of through apertures are provided through the strength members, sized to receive reinforcing rods, and lateral reinforcement is provided to a panel by inserting reinforcing rods through aligned such apertures in the strength members of a panel in a predetermined reinforcing rod schedule. During manufacture of a panel, each strength member is provided with an upper reference surface adjacent its end that is vertically uppermost in use and a lower reference surface adjacent its said opposite end during manufacture. The separation of one said surface from the other for each strength member is controlled during manufacture of said strength members. The upper reference surfaces for all the strength members of a panel are aligned against a straight edge during manufacture of a panel. The method further comprises the step, during the step of location of said second panel, of bringing the lower reference surfaces of said second panel into contact with upper reference surfaces of said first panel before the step of filling the voids of the second panel. Edges of the construction boards are rebated where they meet, and a curable sealant is applied to the region of said rebates immediately before location of the second panel, the cure-rate of the sealant being selected so that the sealant remains essentially liquid for a sufficient period to allow location of the second panel, thereafter hardening to provide resistance to concrete pressure during filling of the voids in the second panel. The construction boards consist of cement particle board, and the settable material comprises a self-compacting concrete, and preferably a concrete that has early strength gain.

In one arrangement, the upper edges of the construction boards of the first panel are outwardly rebated, and the lower edges of the construction boards of the second panel are inwardly rebated so that the boards may overlap with vertical tolerance. In an alternative arrangement, both upper and lower edges are provided with shallow inwardly facing rebates, and metal strips of width greater than the rebates is inserted in the rebates in the upper edges of the construction boards of the first panel to create in effect an outwardly facing rebate.

The reference surfaces may be provided by respectively upwardly facing and downwardly facing length setting plates on the upper and lower ends of the studs, the length setting plates having surfaces that are horizontal when the panel is upright with the strength members extending vertically, so that when the second panel is accurately located on the first panel the downwardly facing horizontal surfaces of the lower length setting plates make facial contact with the corresponding upwardly facing horizontal surfaces of the upper length setting plates of the first panel.

In a second and alternative aspect of this disclosure, methods of building construction are described that employ permanent formwork in which individual panels which may be connected together to form a larger structure comprise two construction boards held apart from each other by spaced metal, preferably steel, studs interconnected by lateral reinforcement, the panels being erected with the steel studs extending vertically, and the void between respective boards being filled with concrete to create a structural reinforced concrete wall. These features are believed novel in themselves.

In this second aspect, the studs are preferably apertured to provide openings, and the lateral reinforcement comprises reinforcing bars, preferably of steel, extending through the openings. They may be attached to the studs. Formation of the apertures may create tabs extending substantially perpendicularly to the plane of the opening, and attachment may then be to the tab or to the remainder of the stud. Attachment is preferably by welding, mechanical fastening or adhesive. Alternatively, lateral reinforcement is provided by reinforcing rods that extend through aligned correspondingly sized apertures in the studs, the studs preferably being provided with additional through openings for concrete to flow around and through the studs when filling the void.

In a further alternative aspect of this disclosure, a strength member is provided for use in the manufacture of pre-formed hollow panels having construction boards held apart by strength members for use in a method for constructing reinforced, filled and set walls by erecting a first panel having strength members extending vertically and with stabbing bars associated with the strength members projecting above the remainder of the panel, by filling the void between the construction boards with a settable material, by locating, before, during or after said filling step, a second said panel vertically above the first by slotting the said stabbing bars into bar receiving portions associated with the lower ends of strength members in the second panel, and by thereafter filling the void between the construction boards of the second panel with said settable material; a said strength member being provided with a plurality of apertures therethrough to allow flow of settable material through and around the strength member, and having a first end and a second end, at least one projecting stabbing bar at said first end, and a bar receiving portion at its second end.

Preferred embodiments of strength member, according to this further aspect, have one or more of the following features: The strength member comprises a steel stud, said at least one projecting stabbing bar also being formed of steel and being welded to the stud adjacent its said first end; the stud comprising an elongate web provided with the said through apertures, and flanges joined to the web along its lateral edges for coupling to the construction boards. Each projecting stabbing bar is provided with a corrosion protection layer selected from zinc galvanising and paint. The stud is provided with a single stabbing bar projecting substantially along the centreline of the stud, and formed from a profiled plate having a first surface on one side and a second surface on its other side, a looped portion of reinforcing rod being welded to at least one of said first and second surfaces to provide enhanced keying between the stabbing bar and the settable material. The bar receiving portion comprises a cage formed at said second end by welding an inverted insert to said stud adjacent said second end, a said single stabbing bar being adapted to be received longitudinally in a central space defined within said cage as a said second panel is located vertically above a said first panel. The strength member further includes a plurality of through apertures sized to receive reinforcing rods to provide lateral reinforcement to a said panel. The strength member comprises an upper reference surface adjacent its first end and a lower reference surface adjacent its second end, the upper and lower reference surfaces being related to each other such that when a said second panel is located vertically above a said first panel and the stabbing bars of strength members of the first panel slotted into bar receiving portions of strength members of the second panel, the respective upper reference surfaces of the strength members of the first panel make facial contact with the respective lower reference surfaces of aligned strength members of the second panel.

In another aspect of this disclosure, a preformed hollow panel is provided for use in a method for constructing reinforced, filled and set walls, the panel comprising construction boards held apart from each other by spaced apertured metal strength members to form a sandwich construction, each strength member being provided with at least one stabbing bar extending beyond an edge of the construction boards, and each strength member having a stabbing bar receiving portion associated with its end opposite the at least one stabbing bar; whereby a structural wall may be erected by the steps of erecting a first said panel with its strength members extending vertically and with the stabbing bars associated with the strength members projecting above the remainder of the panel, by filling the void between the construction boards with a settable material, by locating, before during or after said filling step, a second said panel vertically above the first by slotting the said stabbing bars into bar receiving portions associated with the lower ends of strength members in the second panel, and by thereafter filling the void between the construction boards of the second panel with said settable material.

Preferred embodiments of panel according to this other aspect, may have one or more of the following features: The strength members comprise steel studs and the projecting bars are also formed of steel, each bar being welded to an upper portion of a stud, each stud comprising a vertically extending web and flanges joined to the web along its vertically extending edges, the flanges being coupled to the construction boards. The construction boards are attached to the strength members by an adhesive including an intumescing additive. Each projecting bar is provided with a corrosion protection layer selected from zinc galvanising and paint. Each stud is provided with a single stabbing bar projecting substantially along the centreline of the stud, and formed from a profiled plate having a first surface on one side and a second surface on its other side, a looped portion of reinforcing rod being welded to at least one of said first and second surfaces to provide enhanced keying between the stabbing bar and the settable material. Each stabbing bar receiving portion comprises a cage formed at said opposite end of said stud by welding an inverted insert to said stud adjacent said opposite end, a said single stabbing bar being adapted to be received longitudinally in a central space defined within said cage as a said second panel is located vertically above a said first panel. Each strength member includes a plurality of through apertures sized to receive reinforcing rods, and reinforcing rods interconnect aligned said apertures in the strength members of the panel to provide lateral reinforcement to the panel. Each strength member has an upper reference surface adjacent its end that is vertically uppermost in use and a lower reference surface adjacent its said opposite end, the separation of one said surface from the other for each strength member being controlled to a predetermined value, the upper reference surfaces for all the strength members of a panel being aligned, and the upper and lower reference surfaces being related to each other such that when a said second panel is located vertically above a said first panel and the stabbing bars of strength members of the first panel slotted into bar receiving portions of strength members of the second panel, the respective upper reference surfaces of the strength members of the first panel make facial contact with the respective lower reference surfaces of aligned strength members of the second panel.

BRIEF DESCRIPTION OF THE DRAWINGS

Particular embodiments are described by way of example only with reference to the accompanying drawings, in which:—

FIG. 9 is a front elevation of a first end of an alternative embodiment of stud;

FIG. 10 is a similar view of the opposite end of the stud of FIG. 9;

FIG. 11 is a side elevational view of the structure of FIG. 9, with some parts omitted;

FIG. 12 is a side elevational view of the structure of FIG. 10;

DESCRIPTION OF PREFERRED EMBODIMENTS

Figure 1:
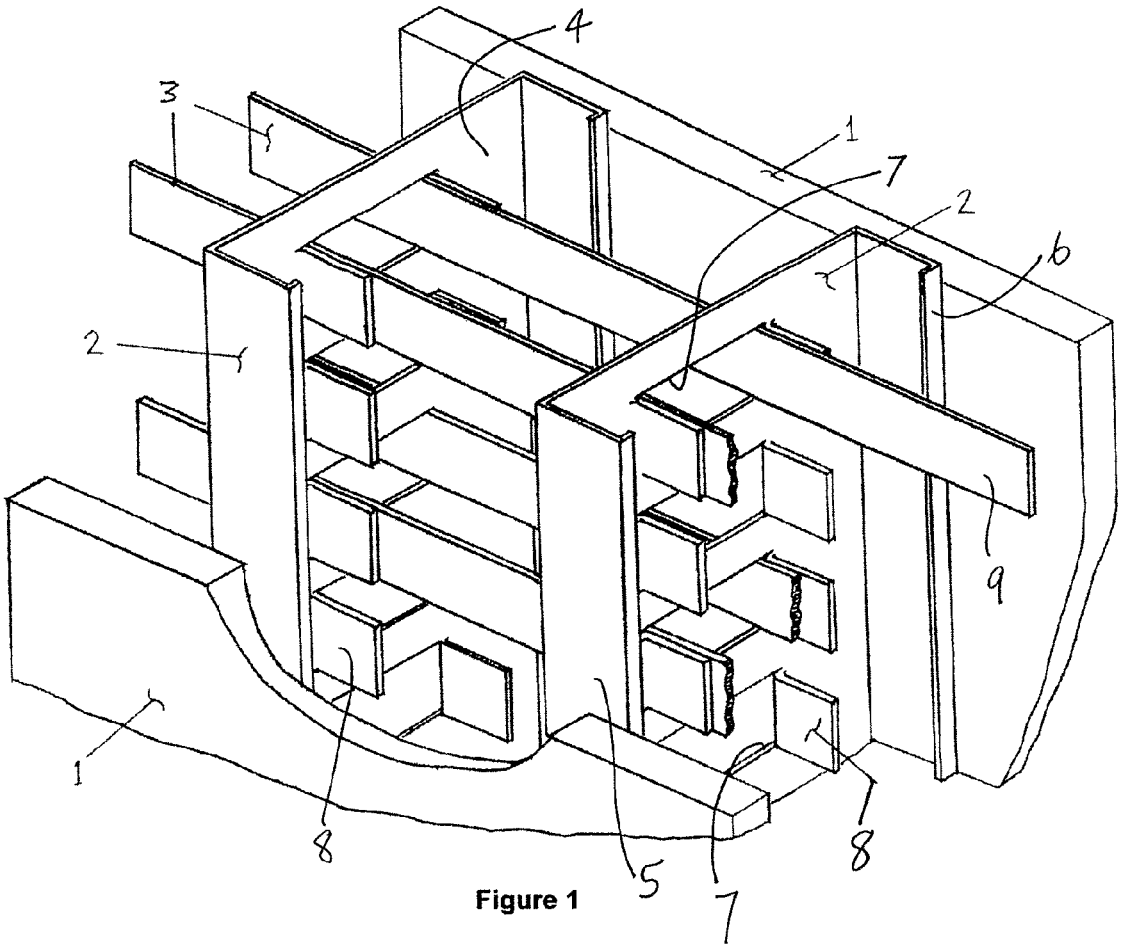
FIG. 1 shows a cut-away perspective view of a section of formwork before addition of concrete in the construction of a wall.
Figure 2:
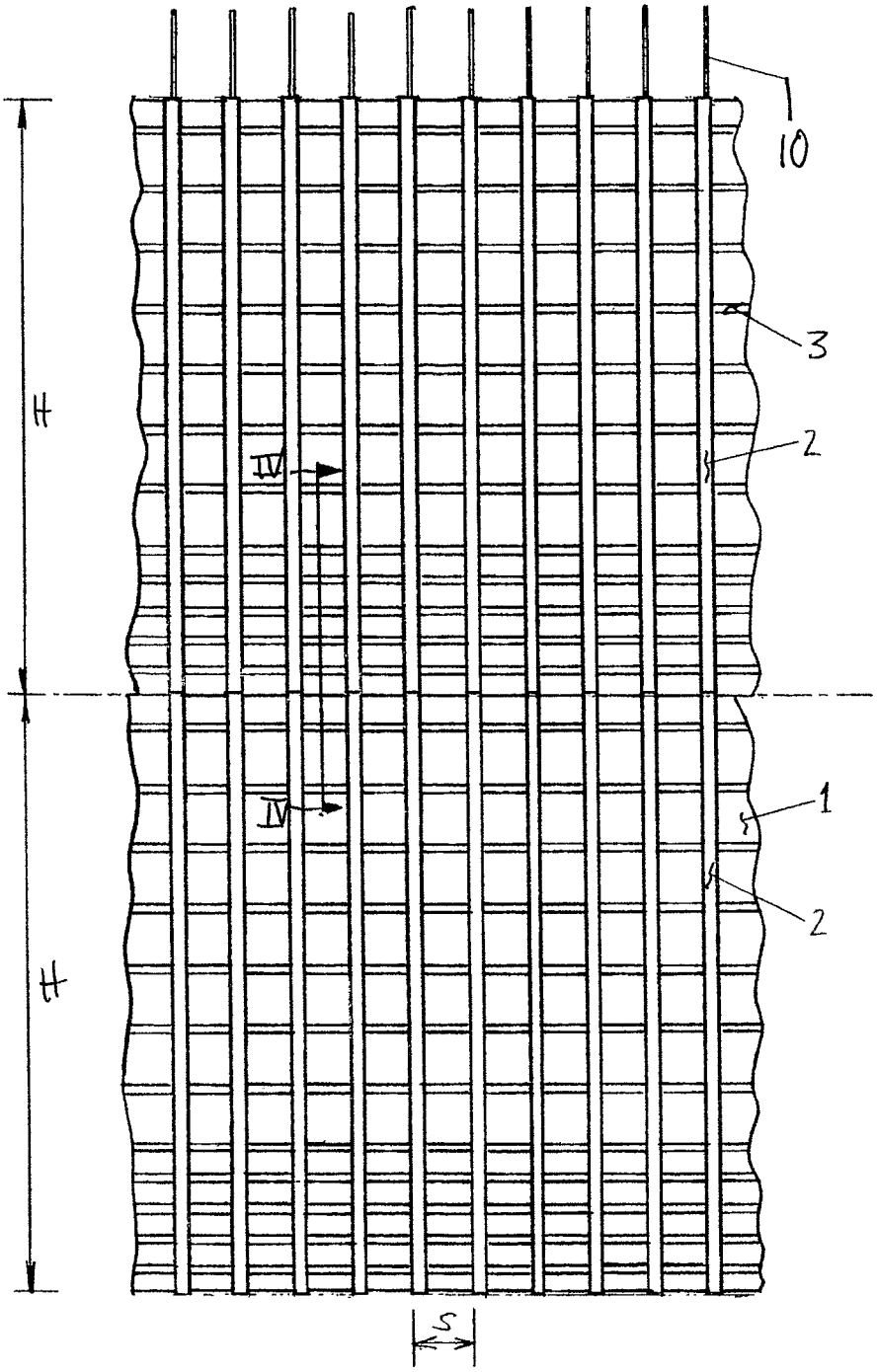
FIG. 2 is a front elevational view of a section of wall comprising two panels shown before addition of concrete, and with the front construction board omitted to show the internal structure.

Referring first to FIGS. 1 and 2, two construction boards [1] are spaced from each other by and attached to strength members, which here comprise steel studs [2] mounted vertically at spaced intervals S (FIG. 2) and interconnected by lateral reinforcement [3]. Each stud [2] is substantially C-shaped in section, comprising a main portion in the form of a stud web [4], and a pair of flanges [5] extending perpendicularly to the stud web and terminating in inwardly directed lips [6]. The construction boards [1] are attached to flanges [5] of the steel studs [2] using adhesive, mechanical fastenings or a combination of both. The adhesive may incorporate an intumescing additive such that in the event that the construction board burns away in fire the adhesive intumesces and provides fire protection to the stud flange.

As best shown in FIG. 1, the stud webs [4] are provided with a plurality of through openings [7] formed by bending either one, or, as here shown, a pair of tabs [8] at right angles out of the plane of the stud web [4]. In the embodiment shown in FIG. 1, the lateral reinforcement [3] is provided by a plurality of steel bars [9] extending generally horizontally through respective openings [7] in a plurality of studs [2] and being attached to a bent tab [8] at each said opening by welding. In this embodiment, the tabs are both bent in the same direction, namely: into the space between the flanges [5]. However, this is not essential. Both tabs of the pair could be bent in the opposite direction. Alternatively, one may be bent in one direction, the other in the opposite direction.

FIG. 2 shows a wall in which two panels have been mounted one above the other in a vertical plane. The front boards have been omitted from the view to show the internal structure. Panel height H is typically the height of a building storey, but need not be. Studs [2] in the lower panel align with the studs [2] in the upper panel. Lateral reinforcement [3] is provided at intervals. In the embodiment shown, the spacing of the lateral reinforcement is reduced in the lower portion of each panel. Stabbing bars [10] are attached to the top of each stud [2] to form a vertical connection between studs. The lower panel will normally, though not necessarily, have been substantially filled with a suitable settable material prior to the upper panel being located. The settable material is suitably a cementitious material, preferably concrete. The concrete employed is preferably a self-compacting concrete, and preferably a concrete that has early strength gain.

Figure 3A:
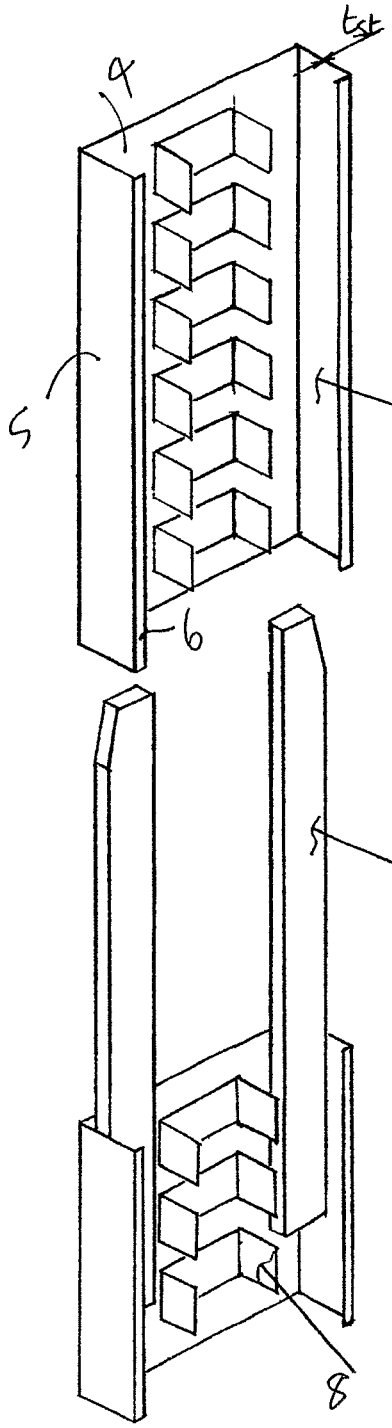
FIG. 3 shows exploded views of cooperating top and bottom ends of studs in two superposed panels as seen, respectively, in FIGS. 3*a* and 3*b*, from front and rear perspective views.
Figure 3B:
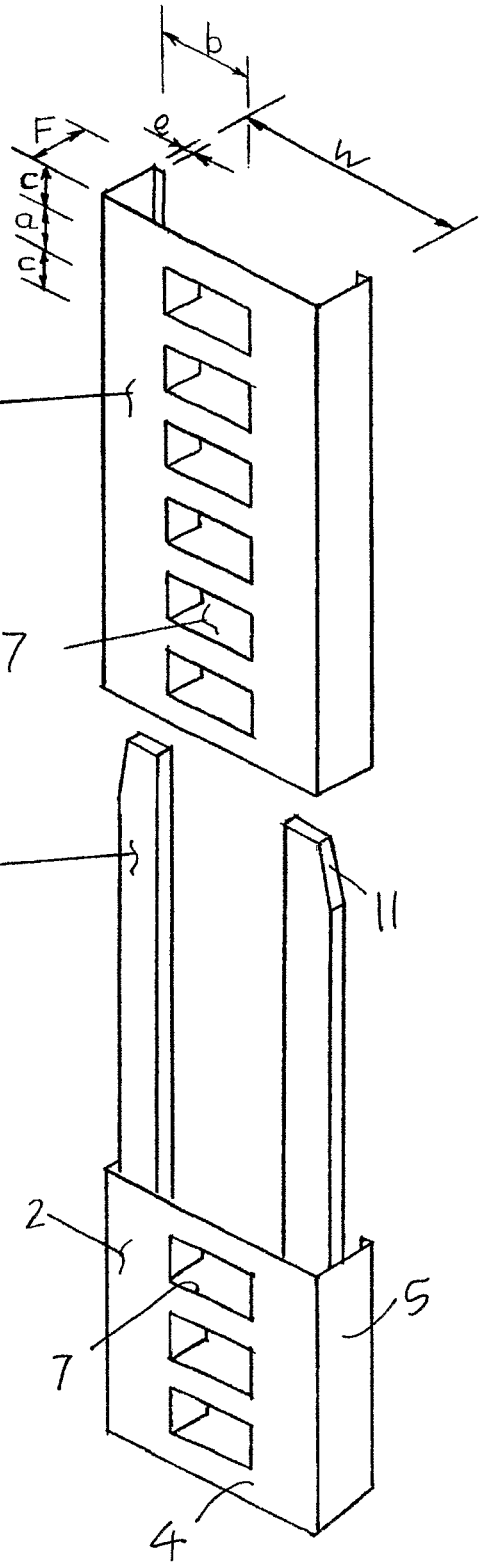

The location and operation of the stabbing bars [10], in this embodiment, is best shown in FIGS. 3*a* and 3*b*, which show the same structure, namely the top part of a stud from a lower panel and the bottom part of a stud from a superposed panel, from opposite sides. The lateral reinforcement has been omitted from these views for clarity. Proximal ends of two stabbing bars [10] extend vertically within respective channels defined between flanges [5] and tabs [8] at the upper end of a stud [2], and are attached to stud web [4] of that stud [2] by welding. The bottom part of the stud of the superposed panel serves as a stabbing bar receiving portion, and slides over the stabbing bars upstanding from the lower panel, the stabbing bars being received in the channels defined between the flanges [5] and the tabs [8] of respective studs [2], and have tapered lead-ins [11] to allow them to be guided into the said channels to aid location of one panel vertically over the other. The stabbing bar and/or the stud, especially the bottom part thereof, may be given a roughened surface in order to grip into the concrete. This may be an epoxy attached grit or a plate with a rolled surface texture such as "floor plate".

The construction boards [1] are preferably cement particle board. In practical examples of the construction system, the boards may be screwed to the stud. The screw location should preferably be close to the stud web [4] in order for the projecting screw not to interfere with the stabbing bar [10]. Alternatively the board may be glued to the stud.

The openings [7] in the studs [2] serve not only to provide space for the reinforcement [3] to pass therethrough, the metal from the opening forming the tabs to which the reinforcement is attached, but serve also to allow concrete to flow laterally within the panel in order to fill all voids.

Each stud has an external width W. Each flange has an external width F. Openings [7] have a height a and a width b, and are separated by a portion of stud web [4] of width c. Lips [6] have a width e. Each stud is formed of steel with a thickness $t_{st}$. These dimensions are inter-related as described below.

Figure 4:
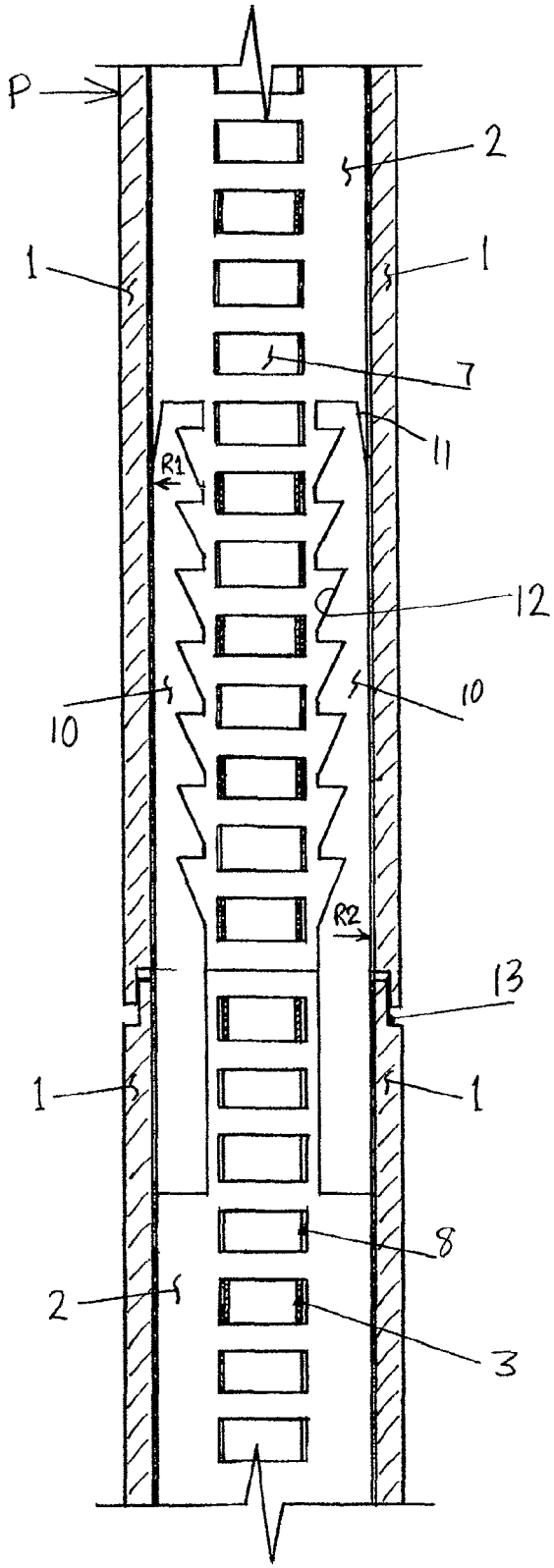
FIG. 4 is an enlarged sectional view through two superposed panels taken along the line IV-IV in FIG. 2.

The sectional view of FIG. 4 shows the stabbing bars [10] fully inserted into a stud [2] of a superposed panel. The stabbing bars [10] are here shown with a serrated edge [12] to better anchor into the concrete. The construction boards [1] are shown with rebates [13] along their top and bottom edges so that the boards overlap when panels are accurately stacked vertically.

Rebates [13] may be formed in various ways. As shown on the right-hand side of the enlarged joint section of FIG. 5, equal depth rebates may be provided on each board, the rebate [14] on the lower edge of the upper panel facing inwards, and the rebate [15] on the upper edge of the lower panel facing outwards. This configuration is preferred over the reverse configuration to discourage ingress of water. On the left hand side the rebate detail comprises two shallow inwardly facing rebates [16], [17] with a metal strip [18] fixed into the lower rebate.

Preferably a curable sealant is applied to one or both rebates immediately before location of the upper panel on the lower one. The cure-rate of the sealant is chosen so that while the second panel is being located and any adjustment made, the sealant remains liquid and serves as a lubricant. After the sealant has hardened, it provides a measure of resistance to concrete pressure during filling of the voids in the upper panel.

Figure 5:
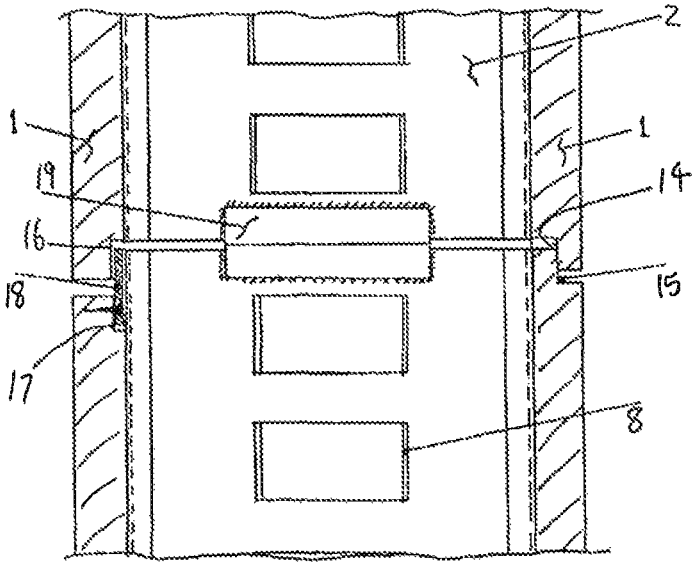
FIG. 5 is a detail view illustrating alternative modes for forming joins between panels.

Also shown in this Figure are length setting plates [19] welded to the respective ends of the studs [2] on an accurate jig so that the length of the stud from the distal horizontal surface of one length setting plate at one end of a stud to the distal horizontal surface of the length setting plate at the other end of the stud is accurately controlled. This is achieved by thermally "soaking" the studs in a chamber so that, at the time of welding, they have a similar temperature to a length setting bar used to set the plates in a jig. The temperature differential is made less than 4° C. they are at a known reference temperature. The length setting plates provide respective upper and lower reference surfaces for each stud. Panels are made by using one length setting block as a datum point. Preferably the top length setting plate of each stud is held against a flat reference surface during panel construction. In so doing the faces of the bottom length setting plates will also align, enabling structures to be constructed to high accuracy simply through the process of placing one panel on top of another with the lower length setting plate of one stud bearing against the upper length setting plate of another, as shown in FIG. 5. Vertical setting is thus determined by the lengths of the studs rather than of the construction boards, the rebated edges of which provide vertical tolerance.

By this means it is possible to achieve a tolerance of better than +/−0.15 mm at a specified reference temperature in the lengths of the studs.

Figure 6:
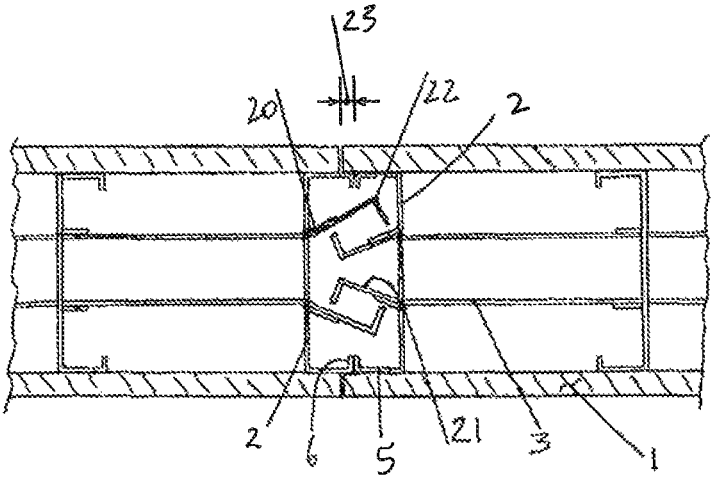
FIG. 6 is a sectional view taken in a horizontal plane showing how two panels may be joined edge to edge.

FIG. 6 shows how the edges of two panels may be butted together on site. The lateral reinforcement [3] is cranked outwardly [20] and inwardly [21] and the ends bent to form lapped hooked ends [22]. The lips [6] of flanges [5] of respective studs abut to form a box-like structure to strengthen the join, with a lap [23] being formed by extending one of the construction boards [1] slightly beyond the end of a stud [2]. Subsequent filling with concrete locks the two panels together with sufficient strength to maintain shear continuity between panels.

Figure 7:
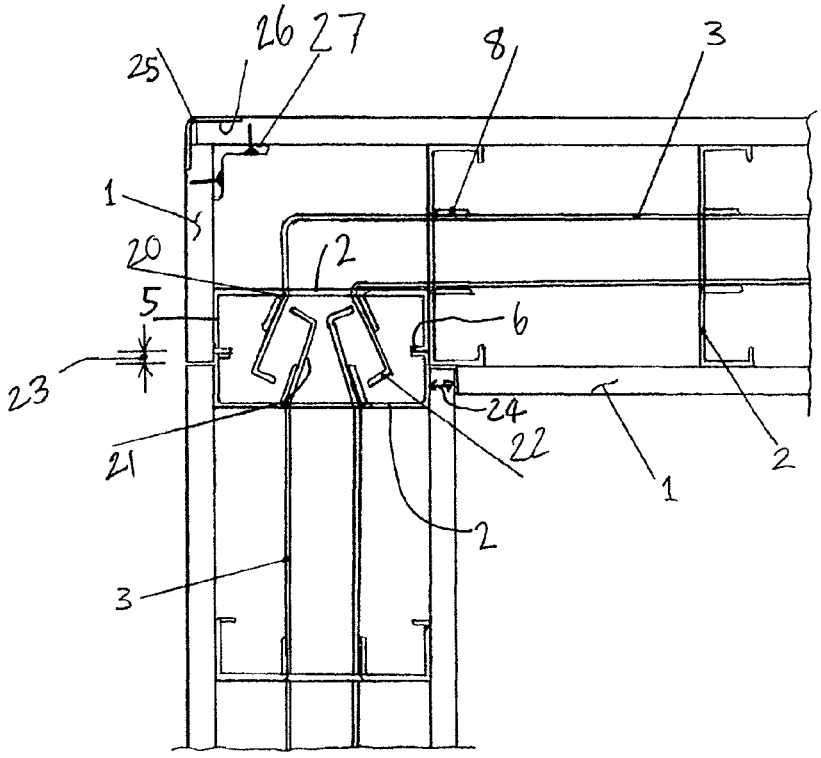
FIG. 7 is a similar sectional view showing how two panels may be joined edge to edge to form a corner.

FIG. 7 shows how a corner may be formed in a generally similar fashion. A box-like structure is again formed by butting lips [6] of flanges [5] of two studs [2] at the join, with the lateral reinforcement again being both cranked outwardly [20] and inwardly [21]. Hooked ends [22] again lap with each other and are locked together by the subsequent concrete filling. The boards [1] are arranged with an overlap [23] as in FIG. 6. On the inner side of the corner, one of the boards is cut back beyond the end of a stud by a distance [24] equal to the width of a board. On the outer side of the corner, a metal angle [25] is secured in shallow rebates [26] in the construction panels, and a metal angle [27] attached internally to the same boards.

Figure 8:
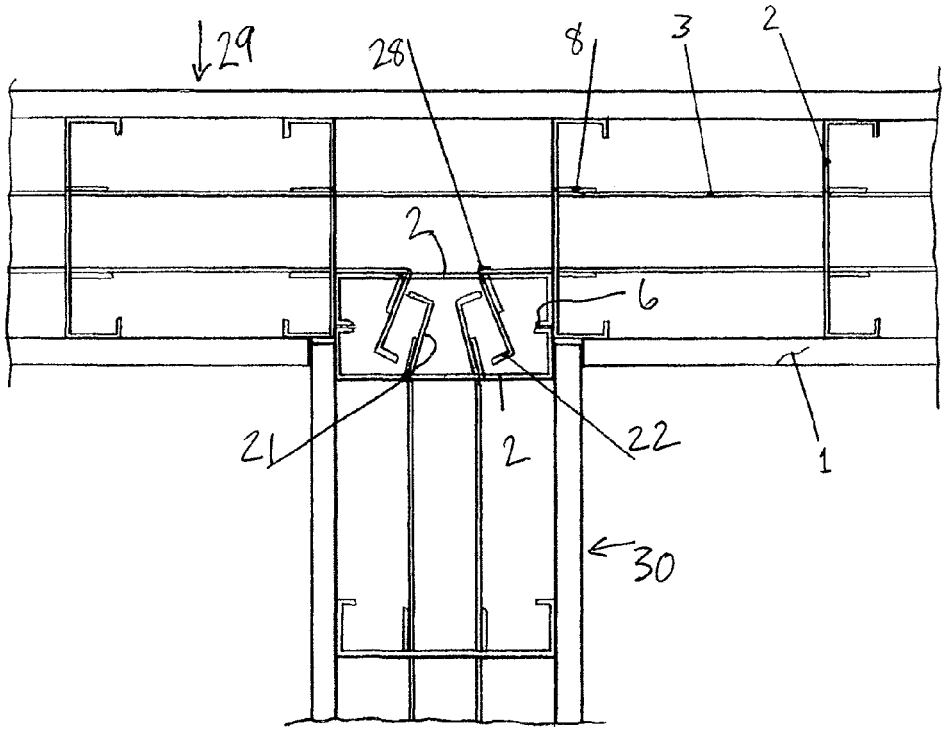
FIG. 8 is a similar sectional view showing how two panels may be butted to form a T-junction.

The same principles may be applied to form a T-junction as shown in FIG. 8. A box-like structure is again formed between two studs. In this case, the lateral reinforcement [3] is bent back to an acute angle [28] in continuous wall [29] to form lapped hooked ends [22] with inwardly cranked portions [21] of reinforcement on the end of the butting wall [30].

An important feature of the described embodiment of construction system is the strength member, here taking the form of a stud [2], which here incorporates a pair of flanges [5] of width F (FIG. 3) which make planar contact with the construction boards [1]. The construction boards [1] are attached to the flange by mechanical fasteners, adhesive or both. The web or main panel [4] of the stud is perforated with openings [6] to allow concrete to flow laterally within the panel. Studs [2] are provided with a means, here the tabs [8], to attach laterally running reinforcement [3] in order to provide the panel with in-plane shear strength. Studs [2] are designed to stack on top of each other. A stabbing bar [10] attached to the top of a stud slots into the bottom of the next stud up. Subsequent filling with concrete of the void between construction boards locks the studs together such that the full tension capacity of a stud is carried across the joint in a slip free manner. The stabbing bar [10] attached to the top of a stud [2] further acts to provide immediate temporary stability to the next stud up pending and during concrete filling of the upper panel. Referring to FIG. 4, the bending moment resulting from the eccentric application of a lateral load P will be resisted by the couple developed by R1 and R2 between the stabbing bars [10] and the stud [2]. The stud [2] resists the tension caused in the stud web as a result of pressure on the construction boards [1] resulting from the head of concrete during concrete filling. The pressure force is transferred from the boards to the stud flange [5] and hence to the web [4]. Stud length can vary to suit any requirement, but typically the length corresponds to the storey height H of a building. Studs are made to a tight length tolerance of less than +/−0.15 mm at a specified reference temperature. This figure has been determined by calculation such that a 3 m wide building core that is 10 storeys high will deviate from vertical at the top by less than 10 mm due to stud length variation. This permits panels to be stacked without the need to accurately adjust heights at each level.

Panel and studs have a number of preferred relationships, as explained below for the embodiments of FIGS. 3 and 4:

1. Flange Width, F.

The flange width must be sufficiently wide to allow the connection between construction board and stud to have sufficient strength to resist the hydrostatic pressure present during concrete filling. The flange width F may be related to the head of concrete (assumed to be the storey height, H in meters), the stud spacing (S, in mm) and the internal bond (tensile strength perpendicular to the plane of the construction board, $F_{ibp}$ in N/mm$^2$) as follows:

$$F \geq (HS/(H+24F_{ibp}))$$

In obtaining this relationship a factor of safety of 1.75 has been applied to $F_{ibp}$ and the density of the fill has been assumed to be 2400 kg/m$^3$ (i.e., normal density concrete).

FIGS. 3 and 4 show various embodiments of the stabbing bar detail. Concrete or sand/cement paste should be able to flow around the stabbing bar in order to fill all voids. Voids must either be less than 5 mm (in which case they will fill with paste without seriously depleting the paste content in the adjoining concrete) or greater than 2.5× aggregate size. For a lipped C-section, the flange width may be given as follows:

$$F \geq 2t_{st}+2.5\times\text{aggregate size}+t_{sb}+3$$

In the above equation the number 3 is taken as the tolerance in the stabbing plate position and $t_{sb}$ is the thickness of the stabbing bar.

2. Stud External Dimension, W.

This determines the thickness of the concrete.

Where it is necessary to meet sound insulation requirements, then the completed wall needs to have a minimum mass per unit area $\rho_{mfsi}$ in kg/m$^2$. With construction board density of $\rho_{cb}$ kg/m$^3$, construction board thickness of $t_{cb}$ mm and concrete fill density of $\rho_{conc}$ kg/m$^3$, the stud external dimension W is suitably defined by:

$$W \geq (1000/\rho_{conc})(\rho_{mfsi}-(t_{cb}\rho_{cb}/500))$$

Structural walls or building core walls, which form the major application for the embodiments of construction system described herein, are subject primarily to compressive force. Examples based on typical walls indicate that approximately 80% of the compressive capacity of a wall is provided by the concrete (the remaining capacity comes primarily from the steel studs). If the wall must resist a compressive force of $N_c$ kN per meter of footprint then using concrete of strength $f_{cu}$, W is preferably defined by:

$$W \geq 1.2N_c/f_{cu}$$

3. Stud Spacing, S.

This is preferably related to the thickness ($t_{cb}$ in mm) and the design flexural strength ($f_{b,cb}$ in N/mm$^2$) of the construction board, the head of concrete (H in m) and the concrete fill density ($\rho_{conc}$ in kg/m$^3$). It is assumed that the stud flanges are sufficiently strong that the board can be considered to span between the edges of the stud flanges, so that the span L is given by L=(S−F). The bending moment M in the board is preferably given by $M=wL^2/10$ where w=load per unit length. Based on these criteria:

$$S \leq F+\sqrt{\{(t_{cb}^2 \cdot f_{b,cb} \cdot 167\times10^3)/(H \cdot \rho_{conc})\}}$$

4. Dimensions of Concrete Flow Opening [7], a×b.

Panels will normally be filled with a highly flowable concrete mix. Such a mix will flow through holes without the hole blocking and without the structure of the concrete being affected (e.g. separating out aggregate from fines) so long as the minimum hole dimension is about 2.5× the maximum aggregate size dimension, i.e., it should be possible to pass a sphere of 2.5× maximum aggregate size through any opening. Thus, in the preferred arrangement:

$$a \geq 2.5\times\text{aggregate size}$$

A single hole will be limited in the rate at which it will allow concrete to pass through. In order not to overly restrict the lateral flow of concrete, the total porosity of the stud web should preferably be greater than 20%. In the example given in FIG. 3, if the distance between openings is c, then, in the preferred arrangement:

$$b \geq 0.2W(a+c)/a$$

Similar expressions can be derived for other shaped web openings so long as the criteria of greater than 20% total web porosity is maintained.

5. Stud Thickness, $t_{st}$.

This will preferably be the thinnest section that satisfies each of the following criteria:

(i) Provision of adequate tensile capacity to resist direct tension, $N_t$, applied to the wall. For a stud material yield strength of $F_{y,st}$, and using preferred geometric terms as defined above, then, in the preferred arrangement:

$$t_{st} \geq 1.1N_tS/(F_{y,st}(W-b+2F+2e))$$

Note that e is the width of the flange lip [6], if present.

(ii) Provision of adequate tying force between construction boards when they are subjected to concrete filling pressures. For a distance between openings of c, then, in the preferred arrangement:

$$t_{st} \geq (1.1S(a+c)\rho_{conc}H)/(cF_{y,st}100{,}000)$$

(iii) It was assumed, above, that the effective span L of the construction board between studs was (S−F). For this to be the case requires that the stud flange, loaded as a cantilever, can take the edge forces applied to it by the board together with the concrete pressures applied directly to it. The following preferred relationship will satisfy this, namely, when:

$$t_{st} \geq \sqrt{\{(3.3\rho_{conc}HSF)/(100{,}000F_{y,st})\}}$$

(iv) Prior to concrete filling, the two opposite construction boards are only linked by the web cross-members of depth c mm between openings [7]. Out-of-plane forces applied to the panel (e.g. force P in FIG. 4) will generate forces in the cross-member. Stresses generated in the web cross-member will be a maximum when the cross-member is perpendicular to the plain of the flange, as shown in the figures. Assuming the maximum out-of-plane forces occur under wind loading in the temporary condition of $w_{wind}$ kN/m$^2$, then, in the preferred arrangement:

$$t_{st} \geq (4.4w_{wind}HS(a+c)b)/(WF_{y,st}c^2)$$

6. Cross-Sectional Area of Lateral Reinforcement Per Meter of Wall, $A_{lr}$ in mm$^2$.

The shear force acting in the plane of the wall is taken as $V_{ip}$ kN per meter of wall. Conservatively ignoring the contribution to shear capacity of the concrete fill, then the shear capacity of any potential failure plane will be approximately equal to the tensile capacity of any steel crossing that plane. Therefore, in the preferred arrangement:

$$A_{lr} \geq 1100V_{ip}/F_{y,lr}$$

Preferably the vertical spacing between lateral reinforcement bars should not exceed the spacing S between studs.

7. Thickness ($t_{sb}$, mm) and Breadth ($b_{sb}$, mm) of Stabbing Bar.

All tension force being transferred vertically from one stud to the other is carried by the stabbing bar. Thickness and breadth are therefore preferably related to the stud geometry and material properties as follows:

$$2t_{sb}b_{sb} \geq (2(e+F)+W-b)t_{st} \cdot F_{y,st}/F_{y,sb}$$

The bending moment caused by $w_{wind}$ should preferably be carried by a single stabbing bar per stud. In the preferred arrangement, the cross-sectional geometry of the stabbing bar should preferably be such that:

$$b_{sb}^2t_{sb} \geq 3300Sw_{wind}H^2/F_{y,sb}$$

8. Length of Stabbing Bar, $L_{sb}$.

The stabbing bar length comprises two elements: $L_{1sb}$ is the length of engagement into the top of the lower stud, while $L_{2sb}$ is the free length projecting from the top of the lower stud and that stabs into the bottom of the upper stud. The lengths are preferably determined as follows:

$L_{1sb}$ should be long enough that there is sufficient engagement in the lower stud to resist the bending moment caused by $w_{wind}$ without overstressing the lower stud. $L_{1sb}$ will be heavily influenced by the thickness of the stud, $t_{st}$, and the manner of attachment of the stabbing bar. In general, concrete will already have been placed prior to the upper panel being stabbed.

$L_{2sb}$ should be long enough to mobilise sufficient shear strength to resist pull-out of the stabbing bar from the concrete. Shear resistance is dominated by the confined surfaces between the stabbing bar face area and the stud web. The limit placed on concrete shear is 5 N/mm$^2$. Therefore, in the preferred arrangement:

$$L_{2sb} \geq N_tS/10b_{sb}$$

unless testing proves a surface profile to allow a lesser length.

The following non-limiting example illustrates the above principles.

EXAMPLE

Stud Flange Width, F

Studs are spaced at S=200 mm. Cement particle board has an internal bond strength perpendicular to the face of $F_{ibp}$=0.6 N/mm$^2$. For a panel height H 3 m, in accordance with the stud spacing F>34.4 mm.

Stud thickness, $t_{st}$=2.5 mm and stabbing bar thickness, $t_{sb}$=6 mm. Taking the maximum aggregate size as 10 mm, this would give F>39 mm Accordingly, in this Example, flange width F=40 mm is therefore preferred.

Stud External Dimension, W

In accordance with UK building regulations, $\rho_{mfsi}$=415 kg/m$^2$. The cement particle board has $t_{cb}$=20 mm and $\rho_{cb}$=1200 kg/m$^3$. Taking $\rho c_{conc}$=2400 kg/m$^3$, sound insulation considerations mean that preferably W≥153 mm.

Taking a typical core wall compressive load of $N_c$=4000 kN, and using concrete of grade $f_{cu}$=30 N/mm$^2$, compressive load considerations mean that preferably W≥160 mm.

Accordingly, in this Example, a stud having W=160 mm is therefore preferred.

Stud Spacing, S

S has already been set at 200 mm. However, taking $f_{b,cb}$=4 N/mm$^2$ and other values as already specified, bending moment considerations give S≤233 mm.

The selected spacing is therefore acceptable.

Concrete Flow Openings

According to the values above, preferably opening dimension, a≥2.5×10=25 mm. Setting a=35 mm in this Example is acceptable.

c=15 mm in this Example. Taking porosity requirements into account, in the preferred arrangement, b≥45.7 mm. Setting b=55 mm in this Example is thus acceptable.

Stud Thickness, $t_{st}$

The four considerations set out above lead to different preferred dimensions for the stud thickness as follows:

The tensile load $N_t$ kN/m in a core wall is considerably less than the compressive load. Thus we may take $N_t$=0.2 $N_c$. With the lip width e=10 mm and $F_{y,st}$=360 N/mm$^2$, tensile considerations give $t_{st}$≥2.4 mm.

Tying force considerations give $t_{st}$≥0.15 mm.

Spanning considerations give, for the preferred arrangement, $t_{st}$≥2.30 mm.

In the temporary condition, and taking $w_{wind}$=0.7 kN/m$^2$, wind loading considerations give $t_{st}$≥0.39 mm.

A chosen stud thickness of 2.5 mm for this Example will satisfy all the above criteria.

Cross-Sectional Area of Lateral Reinforcement, $A_{lr}$

Lateral reinforcement is preferably applied at the same vertical interval as the stud spacing, i.e., 200 mm. Therefore $A_{lr}$=2.5×32×2×1000/200=800 mm$^2$ in this Example. The shear force in the plane of the wall is typically 5% of the wall compression, hence $V_{ip}$=200 kN/m of wall. Setting $F_{y,lr}$=275 N/mm$^2$ gives a preferred minimum $A_{lr}$ of 800 mm$^2$, hence the dimensions chosen for the Example are acceptable.

Stabbing Bar Section, $t_{sb}$×$b_{sb}$

Using steel with $F_{y,sb}$=$F_{y,st}$=360 N/mm$^2$, the preferred relationship between thickness and breadth, the stud geometry and the material properties gives 2 $t_{sb}$ $b_{sb}$≥512 mm$^2$. The chosen values for $t_{sb}$ and $b_{sb}$ give 2 $t_{sb}$ $b_{sb}$=552 mm$^2$ so that this condition is satisfied.

Bending moment considerations for wind require that preferably $b_{sb}^2$ $t_{sb}$≥11550 mm$^3$. The chosen values for $t_{sb}$ and $b_{sb}$ give $b_{sb}^2$ $t_{sb}$=12696 mm$^3$ so that this condition is also satisfied.

Stabbing Bar Lengths, $L_{1,sb}$ and $L_{2,sb}$

Taking the values of the Example, shear resistance considerations imply that $L_{2,sb}$ should preferably be greater than 348 mm.

Local ties and stiffening straps may be required to reinforce the stud locally in order to prevent bending.

All the embodiments described thus far have strength members in the form of studs with through openings [7] spaced along the longitudinal centre line of the stud and with stabbing bars [10] located adjacent flanges [5]. With this geometry, there is a risk, though small, that, since the stabbing bars will protrude from the upper end of a panel, the construction boards [1] of a superposed panel may be damaged by those studs if the superposed panel is not accurately aligned with the panel beneath as it is lowered vertically over the protruding studs. The embodiment of FIGS. 9 to 18 adopts an alternative approach which makes any such risk, already small, much smaller.

Referring to FIGS. 9 to 18, a strength member here takes the form of a stud [31] that is generally H-sectioned in cross-section, having a stud web [32] and a pair of flanges [33] along each edge of the stud web. It will be seen that on one side of the stud web [32] (for convenience, here termed "the front of the stud web") the flanges [33] form a continuous web [34], while on the other side (conveniently termed "the back of the stud web"), the flanges [33] are formed as a series of spaced tabs [35]. The stud web has a series of through openings [36] along each edge thereof adjacent the flanges [33]. It will be seen that in this illustrated embodiment the shape and size of each said through opening [36] correspond to those of a said tab [35], and that positioning and spacing of the openings correspond to those of the tabs. The stud web [32] and flanges [33] may be formed from a metal blank, cut to define edges of the openings [36]. Bending of the flange continuous web [34] and of the tabs [35] through a right angle leaves the openings [36] in the stud web [32]. It should be noted that the resultant through openings [36] are adjacent the flanges [33] of the stud rather than spaced along the centreline as in previously described embodiments.

Conversely, the stabbing bars [37] are here positioned to project along the centreline of the stud [31], as explained below, rather than being positioned adjacent the flanges as in the previously described arrangements.

Figures 13, 14:
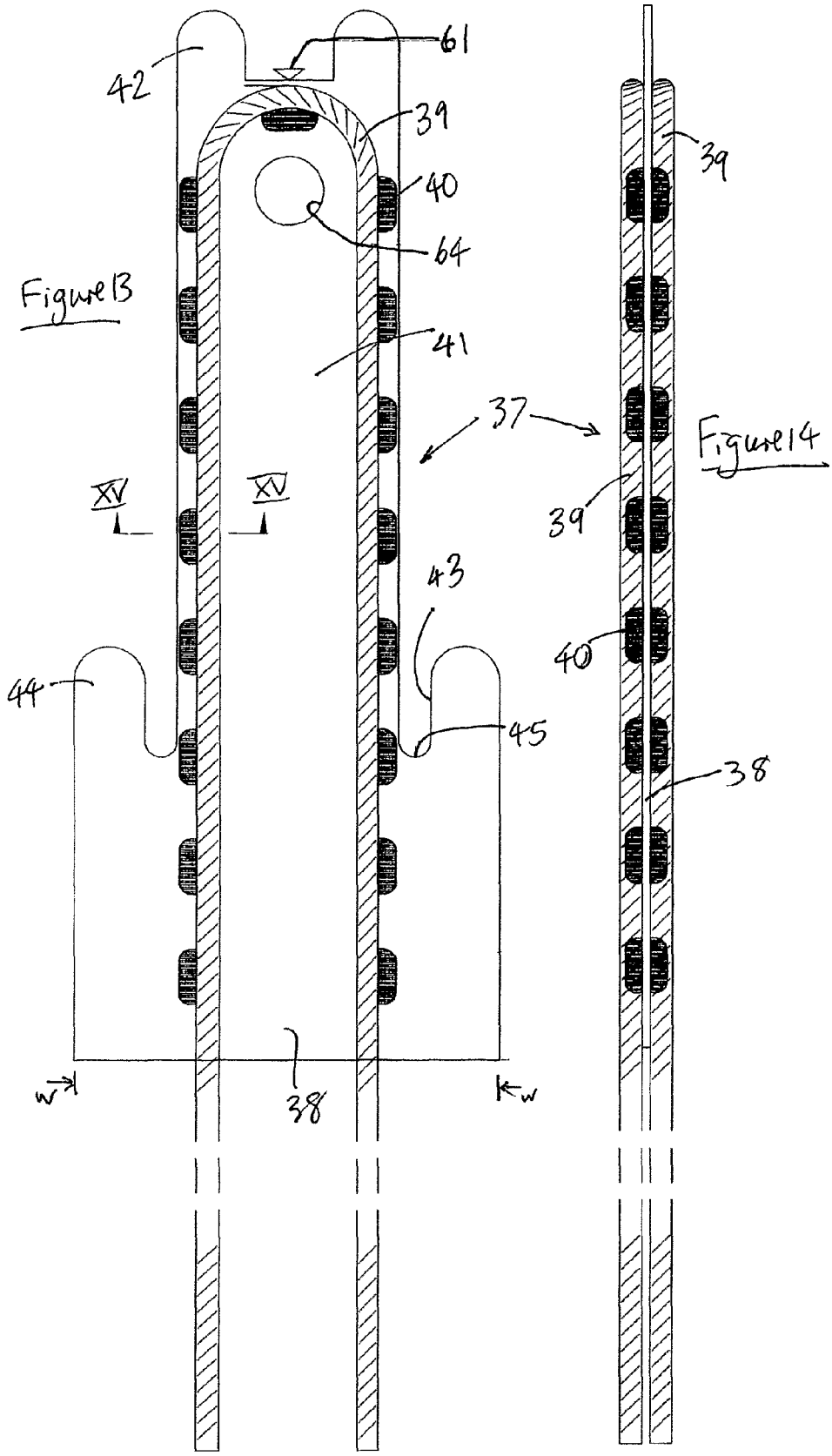
FIG. 13 is a front elevational view of a stabbing bar on an enlarged scale.
FIG. 14 is side elevational view of the stabbing bar of FIG. 13.
Figure 15:
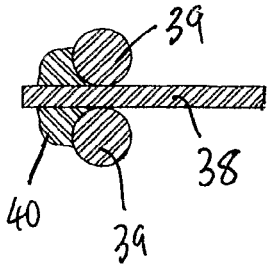
FIG. 15 is an enlarged sectional view taken along the line XV-XV in FIG. 13.
Figure 16:
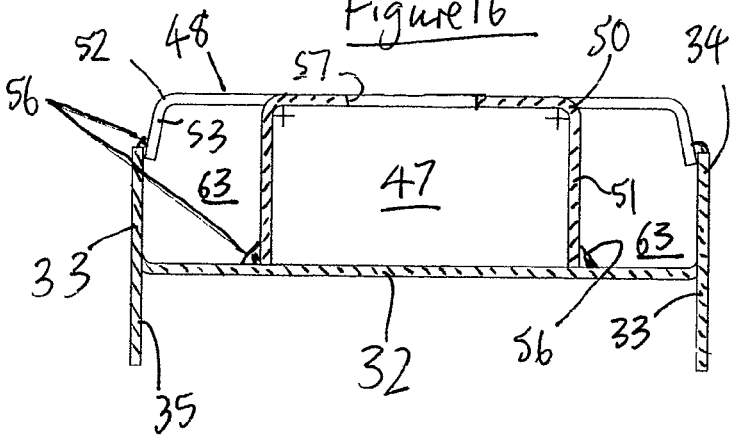
FIG. 16 is an enlarged sectional view taken along the line XVI-XVI in FIG. 10.

As best shown in FIGS. 13 and 14, a stabbing bar [37] comprises a stabbing plate [38] to both sides of which are welded bent lengths of conventional steel reinforcing rod [39], the welds [40] having a highly convex form, as best shown in FIG. 15, and being located at spaced intervals along the reinforcing rods. Such reinforcing rods, often termed "reinforcing bars" or "rebars" (although they have more of a "rod" rather than "bar" form) in the construction industry, are a conventional staple product of the construction industry, and have a ridged rough exterior form to provide grip with concrete. The present Inventor has found that use of the bent lengths of reinforcing rod [39] (shown in FIGS. 9, 13 and 14, but omitted from FIG. 11 for clarity) and of highly convex welds, as shown in FIGS. 13, 14 and 15, provides adequate keying with concrete to avoid the need for epoxy applied grit, or saw-tooth profiling, as in the previously described embodiments. Stabbing plate [38] has a width, w, enabling it to be received between flange webs [34] on the front side of the stud web, and to be welded to the said flange webs. It has a central extended portion [41] with two fingers [42] at its distal end, which extended portion is separated by respective spaces, defining slots [43] for a purpose to be explained, from respective fingers [44] at the edges of the plate [38]. It will be seen from FIG. 10 that the bottoms [45] of the slots [43] are located a short distance beyond uppermost edge [46] of the stud web and flanges.

Figure 17:
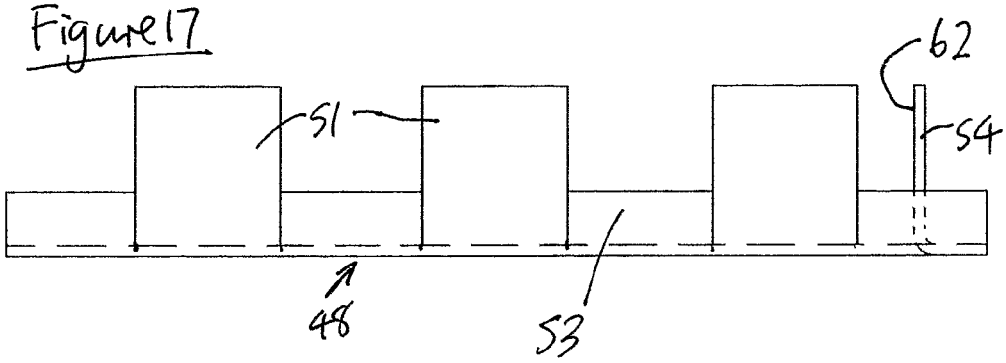
FIG. 17 is a side view of a cage-forming insert.
Figure 18:
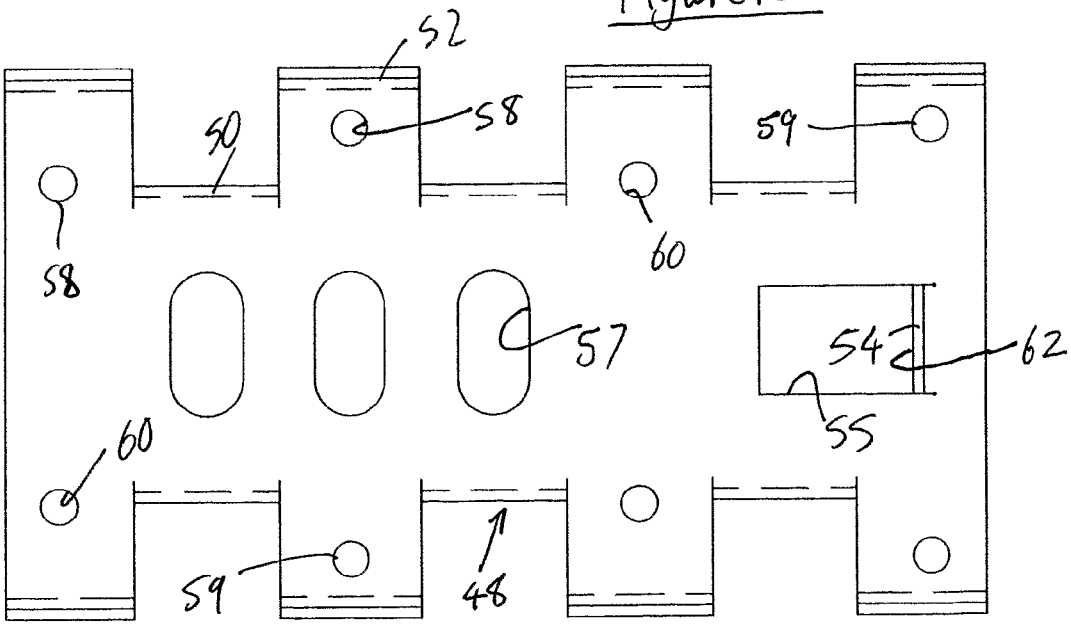
FIG. 18 is an elevational view of the insert of FIG. 17 as seen from above in that Figure.

Extended portion [41] of the stabbing bar is received in a longitudinally extending space [47] (FIG. 16) defined between the front face of stud web [32] and an insert [48] welded to the lower end of the stud [31] to define a stabbing bar receiving cage [49] at the lower end of a stud. Insert [48] is formed from a flat plate formed with a series of cuts along each edge. As best shown in FIGS. 17 and 18, alternate portions between adjacent cuts are bent through a right-angle along lines [50] to provide first upstanding portions [51] while the remaining portions are bent through an angle slightly less than a right-angle along lines [52] to provide second upstanding portions [53] outboard of the first upstanding portions and of shorter extent. Adjacent one end of the insert, a tang [54] is bent through a right-angle out of the plane of the flat panel, thereby leaving a through opening [55], to extend in a plane that is at right-angles to the planes defined by the first upstanding portions. The insert is inverted over the front face of the stud web, and welds [56] are formed between the first upstanding portions [51] and the front face of stud web [32], between tang [54] and the front face of the stud web, and between the second upstanding portions [53] and edges of flange webs [34], as shown in the sectional view of FIG. 16. Insert [48] has additional through openings [57] to aid flow of concrete into the space between the insert and stud web [32].

The flanges [33] of a series of studs [31] aligned in parallel are coupled to a pair of spaced construction boards to form a panel, as in the previously described embodiments. It will be seen from FIGS. 9, 10 and 18 that both the stud web [32] and the flat panel of insert [48] are each formed with a plurality of round through apertures [58] arranged in four rows, the apertures in the insert [48] corresponding in position to the apertures in the stud web [32] when the insert is welded to the stud. A first row [59] of apertures [58] is positioned close to each flange [33], formed through the remaining material of a stud web between alternate pairs of through openings [36], while a second row [60] of apertures is positioned in-board of the first row. Reinforcing rods are inserted through aligned apertures of the studs [31] making up a panel to provide lateral reinforcement between studs, employing a selected reinforcing rod schedule in which the ends of at least some reinforcing rods suitably have an end portion bent through a right-angle to provide an "L" shape, the "L" being directed up, down or horizontally left or right according to the rod schedule. At the lateral side edges of a panel, where two panels meet, the construction board on one side of each panel may extend beyond the other so that the vertically extending meeting lines for the respective boards are staggered on opposite sides of the wall. In the region where construction boards of one panel overlap with those of another adjacent panel, one of the panels may have reinforcing rods with an upwardly directed "L", while the other has rods with a downwardly directed "L", or the panels may have oppositely horizontally directed "L" portions.

As one panel is lowered on to another in erecting a wall, extended portion [41] of each stabbing bar [37] is inserted into cage [49] at the lower end of a corresponding stud on the upper panel until a reference surface [61] defined between distal fingers [42] of the stabbing bar makes contact with a second reference surface [62] defined by the surface of tang [54]. The distance between these two reference surfaces for a particular stud is accurately maintained, while the respective reference surfaces [61] for all the studs of a particular panel are accurately aligned along a straight edge during factory manufacture of a panel. The slots [43] are aligned with the lowermost apertures [58] to allow fingers [44] to enter space [63] (FIG. 16) defined between the lowermost reinforcing rods and the lowermost of the first upstanding portions [51] on one side and flange webs [34] on the other. Each stabbing bar has a lifting through hole [64] in its extended portion [41] suited to receive a small bow shackle to aid in lifting and lowering a panel.

Persons of ordinary skill in the construction of reinforced concrete structures will readily appreciate that similar calculations to those set out above for the embodiments of FIGS. 1 to 8 may be carried out for the embodiment of FIGS. 9 to 18, yielding, in a similar fashion, preferred values for this embodiment for the flange width, stud external dimensions, stud spacing, dimensions of the various concrete openings, stud thickness, total cross-sectional area of the lateral reinforcement provided by reinforcing rods, and the thickness, breadth and length of the stabbing bars.

Panels are suitably manufactured in a factory environment employing the various described embodiments of stud. Ex-works they may be provided with additional lifting points besides the lifting points [64] provided in the embodiment of FIGS. 9 to 18. Panels are stored upright.

Panels are suitably transported in a vertical orientation on a flatbed lorry. End frames, into which the panels slot, may be provided to hold them upright during loading and unloading. Adjacent panels may be clamped to each other, creating a solid block of panels on the lorry. The block of panels is ratchet strapped to the lorry to prevent movement. Typical panel weight is approximately 90 kg/m$^2$ so that up to 250 m$^2$ of panel can be transported on a suitable flatbed. In selecting an appropriate vehicle it should be noted that the load has a high centre of gravity. The panels do not need to be protected from the weather.

The groundwork contractor should prepare the foundation leaving a line of M24 holding down bolts spaced at typically 200 mm centres. Channels cooperating with the lower edges of the first panels slot over and bolt to the holding down bolts. Level is set using an engineers' level with accuracy better than 0.25 mm/m. The structure will build at 90 degrees to the plane defined at this stage so that accuracy is critical. A fast setting grout is grouted under the channel.

The individual panels are suitably lifted using two equal length slings. Shackle holes may be provided at the top of the panel. Due to the height of the top of the panels above ground (circa 4.5 m) when on the flatbed, a mobile elevated working platform (MEWP) may be required to attach the slings. The MEWP may also be required to remove the clamps that secure adjacent panels to each other. Panels will lift horizontally. Since they have relatively low weight for their size, they will be prone to movement by wind. Tethers should be secured to the panels in order to help guide them into position using a crane, which should preferably have at least 2.5 tonne lifting capacity.

Before locating a second panel above a first panel, any high points in the concrete around the studs should be removed. The length setting blocks or reference surfaces may be protected by protective plastics strips, which must be removed. A sealant selected for the prevailing conditions should be applied to the rebates.

Panels may be lifted directly from the lorry into position. They must be installed vertically over the last portion, preferably 500 mm, of descent to ensure location of stabbing bars of the lower panel with studs of the panel being placed in position and of respective length setting plates. During this period rebates in horizontally adjacent panels will be engaged. The sealant is designed to operate as a lubricant during this period. Despite this the self weight of the panel may not be sufficient to overcome all the friction present (note that the stabbing bars may also be rubbing on the steel studs). Two means of assisting final location may be provided, namely vibrators attached to captive nuts in the panel, and pullers, attached to screwed on brackets. Fine adjustment to horizontal position is made, before the sealant hardens, using special pushers and pullers attached to screwed on brackets.

Where required in order to hold panels together until concrete filling is complete, screw on plates and angles may be secured across panel joints.

The concrete used to fill the panel is preferably a grade 30 (or greater) self compacting concrete with maximum aggregate size of 10 mm. The crane is used to lift the concrete into place. Crane hook time is optimised by using two skips, each holding circa 1 m$^3$ of concrete and having a total lift weight of just under 3 tonnes. Whilst one skip is on the ground being filled up, the other is being lifted, discharged and then returned to the ground. The crane hook is then swapped over to the other now full skip and the operation repeated. Since discharge into a panel is rapid, a well coordinated site should be able to place circa 12 $m^3$/hr. This is equivalent to filling 75 $m^2$ of wall an hour. Alternatively a single skip may be employed with special brackets to locate the skip correctly at the top of a panel.

A panel is full when the concrete level is within 20 mm of the top. It should be noted that clean finishing will substantially reduce subsequent preparation work. If the weather forecast is for frost or rain, then the open top of the panels should be sheeted.

The panels may be provided with captive nuts that anchor back into the concrete enabling beams and deck support angles to be bolted directly to the panels after filling and setting of the concrete, without the need for setting out and drilling. Subject to the beam load being less than a specified value, the beam may even be attached before concrete filling.

Screwed brackets for pushers and pullers will normally lie within the floor depth and can generally be left in situ. Where they lie in the middle of a flat wall they can be unscrewed and the screw holes made good with filler.

Practical embodiments of the construction system described herein may provide significant advantages, as follows: —

For the Developer:

- Personnel numbers are reduced and duration of work at height is limited.
- There is minimal waste during production and installation.
- Environmental benefits gained from reduced construction duration and construction related noise.
- Earlier return on investment through reduced project program.
- Increased lettable floor area by using the surface of the construction boards as the final finish, eliminating further finishes and supporting elements such as dry lining.
- Reduction in material costs by utilising temporary works items (namely: formwork) as part of the permanent works.
- The panels may be designed to meet acoustic and fire requirements.
- The finished quality of the project is improved due to the dimensional accuracy inherent in use of the panels, especially in relation to interfaces (doors, lifts etc).
- There are near zero maintenance requirements since the product is made from durable, high quality, moisture resistant materials.

For the Architect:

- The finished wall thickness is confidently that of the panels.
- Tolerance provisions for wall position and thickness will be small. This offers opportunities to reduce overall dimensions (e.g. of lift shafts), releasing more floor space within the building.
- The panels when filled can be designed to achieve a 2 hour fire rating, the maximum fire rating currently required by UK Building Regulations, so that the wall can be specified at any location within a building without concern for the fire rating of the zone.
- The panels when filled can be designed to meet acoustic requirements for use as a separating wall (party wall) in accordance with Approved Document E of the Building Regulations.
- Cement particle board provides a flat, ready for decorating, surface. Being a timber based product, the wall finish is both warmer to the touch and more resilient than either steel or unfinished concrete.
- Where service runs are known in advance (e.g. power cables), conduits and boxes can be factory fitted into the panels. This eliminates unsightly surface run cables and prevents the increase in wall thickness resulting from the creation of a service void using dry-lining.
- Reduced site made joints enhance quality of finish and reduction in finishing trades.

For the Engineer:

- Strength and stiffness of a concrete filled panel is almost identical to that of an equivalent thickness reinforced concrete wall.

For the Quantity Surveyor:

- Straight forward product erection (including concrete filling) allows confidence in time saving predictions. Such time savings can be factored into the overall costing via savings in preliminaries and earlier project completion.

For the Contractor:

- The overall site programme may be reduced through reduction of critical path activities.
- Cost of formwork is incorporated into permanent solution, reducing overall material costs.
- There is no formwork to strike and scrap, hence reducing site labour. There is virtually no wastage associated with use of this system.
- Panels may be erected straight from the transport substantially eliminating the need for a lay-down/storage area.
- Preliminaries are significantly lower since the product has no significant demand on the site infrastructure.
- Panels are stable once placed and can therefore be detached from a crane immediately, reducing crane hook time and/or speeding up the rate of panel installation.

The system readily enables one storey per day to be constructed (including concrete filling) subject to the provision of sufficient hook time. Successive storeys can be erected on consecutive days up to a theoretical height of about 10 storeys. Thus, 10 storeys may be constructed in 10 working days.

The invention claimed is:

1. A method for constructing reinforced, filled and set walls, the method comprising the steps of:

providing a plurality of unitary pre-formed panel structures, each panel structure comprising two construction boards fixedly held apart from each other by a pre-set distance to form a hollow sandwich construction by a plurality of apertured strength members and with a void defined between the construction boards, the strength members being spaced from each other, each strength member comprising a vertically extending web and a pair of flanges, each flange being directly joined to the web along a vertically extending edge of the web, with one said flange being coupled to one construction board, the second said flange being coupled to the other construction board, and the web extending between the construction boards, and at least one bar joined to a first portion of the strength member and extending beyond an edge of the construction boards to form a stabbing bar, and each strength member having a bar receiving portion located adjacent to the end of the strength member opposite the first portion;

placing a first said panel structure in an erect position with the first said panel structure's strength members extending vertically and with the stabbing bars projecting above the remainder of the panel structure;

filling the void between the construction boards with a settable material;

before, during or after said filling step, locating a second said panel structure vertically above the first by lowering the second said panel structure on to the first such panel structure so that respective stabbing bars of the first panel structure slot into bar receiving portions of strength members in the second panel structure; and thereafter filling the void between the construction boards of the second panel structure with said settable material.

2. A method according to claim 1, wherein each strength member comprises a steel stud forming said web and flanges and formed of steel, the stabbing bars also being formed of steel, each stabbing bar being welded to an upper portion of a stud.

3. A method according to claim 1, wherein the construction boards are attached to the strength members by an adhesive including an intumescing additive.

4. A method according to claim 1, including the step of conferring a surface profile to at least one of the stabbing bars and the bar receiving portions by a surface profiling method to thereby key into the settable material such that, when the settable material fills voids in the second panel structure, tension continuity is established between the strength members of the two panels, the surface profiling method being selected from the group consisting of one or more of rolling a profile into the surface of at least one of the stabbing bars and lower end portions of the strength members, providing the edge of the stabbing bars with a serrated or re-entrant shaped edge profile, adhesively bonding aggregate particles to the surface of at least one of the stabbing bars and lower end portions of the strength members, and welding portions of reinforcing rods to surfaces of the stabbing bars.

5. A method according to claim 1, further including the step of providing lateral reinforcement to each panel structure.

6. A method according to claim 5, wherein each strength member includes a plurality of through apertures sized to receive reinforcing rods, and wherein the step of providing lateral reinforcement comprises inserting reinforcing rods through aligned apertures in the strength members of a panel structure in a predetermined reinforcing rod schedule.

7. A method according to claim 1, further comprising the steps, during manufacture of a panel structure, of providing each strength member with an upper reference surface adjacent the strength member' end that is vertically uppermost in use and a lower reference surface adjacent the strength member' an opposite end, controlling the separation of one said surface from the other for each strength member during manufacture of said strength members, and aligning the upper reference surfaces for all the strength members of a panel structure against a straight edge during manufacture of a panel structure; and the method further comprising the step, during the step of location of said second panel structure, of bringing the lower reference surfaces of said second panel structure into contact with upper reference surfaces of said first panel structure before the step of filling the voids of the second panel structure.

8. A method according to claim 7, wherein the construction boards are rebated where they meet, and wherein the method comprises the step of applying a curable sealant to the region of said rebates immediately before location of the second panel, the cure-rate of the sealant being selected so that the sealant remains essentially liquid for a sufficient period to allow location of the second panel, thereafter hardening to provide resistance to pressure of the settable material during filling of the voids in the second panel.

9. A method according to claim 1, wherein the construction boards consist of cement particle board, and the settable material comprises a self-compacting concrete, the method comprising the step of allowing the concrete to self compact.

10. A strength member for use in the manufacture of unitary pre-formed hollow panel structures having two construction boards fixedly held apart from each other by a pre-set distance by strength members to form a hollow sandwich construction with a void defined between the construction boards for use in a method for constructing reinforced, filled and set walls by placing a first said panel structure having strength members extending vertically and with stabbing bars joined to and forming part of the strength members projecting above the remainder of the panel structure, by filling the void between the construction boards with a settable material, by locating, before, during or after said filling step, a second said panel structure vertically above the first by lowering the second said panel structure on to the first such panel structure so that respective stabbing bars of the first panel structure slot into stabbing bar receiving portions of the lower ends of strength members in the second panel structure, and by thereafter filling the void between the construction boards of the second panel structure with said settable material; a said strength member being provided with a plurality of apertures therethrough to allow flow of settable material through and around the strength member, and having a first end and a second end, and comprising:

a vertically extending web and a pair of flanges, each flange being directly joined to the web along a vertically extending edge of the web, one said flange being arranged to be coupled to one construction board and the second said flange being arranged to be coupled to the other construction board in said panel structure to hold the two construction boards apart from each other by said pre-set distance, with the web extending between the construction boards, and at least one projecting stabbing bar joined to a first portion of the strength member at said first end and arranged to extend beyond an edge of the construction boards in said panel structure, and the strength member defining at least one stabbing bar receiving portion at said second end.

11. A strength member according to claim 10, comprising a steel stud forming said web and flanges, said at least one projecting stabbing bar also being formed of steel and being welded to the stud adjacent the at least one projecting stabbing bar's said first end.

12. A strength member according to claim 11, provided with a single stabbing bar projecting substantially along the centreline of the stud, and formed from a profiled plate having a first surface on one side and a second surface on its other side, a looped portion of reinforcing rod being welded to at least one of said first and second surfaces to provide enhanced keying between the stabbing bar and the settable material.

13. A strength member according to claim 12, wherein the bar receiving portion comprises a cage formed at said second end by welding an inverted insert to said stud adjacent said second end, a said single stabbing bar of said first panel structure being adapted to be received longitudinally in a central space defined within a said cage of a said single stabling bar of a said second panel structure as a said second panel structure is located vertically above a said first panel structure.

14. A strength member according to claim 10, further including a plurality of through apertures sized to receive reinforcing rods to provide lateral reinforcement to a said panel.

15. A strength member according to claim 10, comprising an upper reference surface adjacent said first end and a lower reference surface adjacent said second end, the upper and lower reference surfaces being related to each other such that when a said second panel structure is located vertically above a said first panel structure and the stabbing bars of strength members of the first panel structure slotted into bar receiving portions of strength members of the second panel structure, the respective upper reference surfaces of the strength members of the first panel structure make facial contact with the respective lower reference surfaces of aligned strength members of the second panel structure.

16. A unitary pre-formed hollow panel structure for use in a method for constructing reinforced, filled and set walls, the panel structure comprising two construction boards fixedly held apart from each other by a pre-set distance to form a hollow sandwich structure by a plurality of apertured strength members and with a void defined between the construction boards, the strength members being spaced from each other, each strength member comprising a vertically extending web and a pair of flanges, each flange being directly joined to the web along a vertically extending edge of the web, with one said flange being coupled to one construction board, the second said flange being coupled to the other construction board, and the web extending between the construction boards, and at least one bar joined to a first portion of the strength member and extending beyond an edge of the construction boards to form a stabbing bar, and each strength member having a stabbing bar receiving portion located adjacent to the end of the strength member opposite the first portion;

whereby a structural wall may be erected by the steps of placing a first said panel structure in an erect position with its strength members extending vertically and with the stabbing bars projecting above the remainder of the panel structure, by filling the void between the construction boards with a settable material, by locating, before, during or after said filling step, a second said panel structure vertically above the first by lowering the second said panel structure on to the first such panel structure so that respective stabbing bars of the first panel structure slot into respective stabbing bar receiving portions of strength members in the second panel structure, and by thereafter filling the void between the construction boards of the second panel structure with said settable material.

17. A panel structure according to claim 16, wherein each strength member comprises a steel stud forming said web and flanges, and the projecting bars are also formed of steel, each bar being welded to an upper portion of a stud.

18. A panel structure according to claim 17, wherein each said stud is provided with a single stabbing bar projecting substantially along the centreline of the stud, and formed from a profiled plate having a first surface on one side and a second surface on its other side, a looped portion of reinforcing rod being welded to at least one of said first and second surfaces to provide enhanced keying between the stabbing bar and the settable material.

19. A panel structure according to claim 18, wherein each stabbing bar receiving portion comprises a cage formed at said opposite end of said stud by welding an inverted insert to said stud adjacent said opposite end, a said single stabbing bar being adapted to be received longitudinally in a central space defined within said cage as a said second panel is located vertically above a said first panel.

20. A panel structure according to claim 16, wherein the construction boards are attached to the strength members by an adhesive including an intumescing additive.

21. A panel structure according to claim 16, wherein each strength member includes a plurality of through apertures sized to receive reinforcing rods, and wherein reinforcing rods interconnect aligned said apertures in the strength members of the panel structure to provide lateral reinforcement to the panel structure.

22. A panel structure according to claim 16, wherein each strength member has an upper reference surface adjacent an end that is vertically uppermost in use and a lower reference surface adjacent an opposite end, the separation of one said surface from the other for each strength member being controlled to a predetermined value, the upper reference surfaces for all the strength members of a panel structure being aligned, and the upper and lower reference surfaces being related to each other such that when a said second panel structure is located vertically above a said first panel structure and the stabbing bars of strength members of the first panel structure slotted into bar receiving portions of strength members of the second panel structure, the respective upper reference surfaces of the strength members of the first panel structure make facial contact with the respective lower reference surfaces of aligned strength members of the second panel structure.

* * * * *